US006578789B1

(12) United States Patent
Braun et al.

(10) Patent No.: US 6,578,789 B1
(45) Date of Patent: Jun. 17, 2003

(54) DEFLECTION METHOD AND DEFLECTION DEVICE FOR A STRIP, ESPECIALLY A METAL STRIP

(75) Inventors: Martin Braun, Kreuztal (DE); Günter Kneppe, Hilchenbach (DE); Uwe Raschke, Haiger-Fellerdilln (DE); Reinhard Irle, Hilchenbach (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/762,033

(22) PCT Filed: Aug. 4, 1998

(86) PCT No.: PCT/EP99/05305

§ 371 (c)(1),
(2), (4) Date: Apr. 9, 2001

(87) PCT Pub. No.: WO00/07747

PCT Pub. Date: Feb. 17, 2000

(30) Foreign Application Priority Data

Aug. 4, 1999 (DE) ..... 198 35 110

(51) Int. Cl.[7] ..... B65H 18/08

(52) U.S. Cl. ..... 242/531.1; 242/615.1; 242/566

(58) Field of Search ..... 242/531.1, 615.1, 242/615.11, 615.4, 566, 532.2; 72/146, 148

(56) References Cited

U.S. PATENT DOCUMENTS

| | | | | |
|---|---|---|---|---|
| 3,243,181 A | | 3/1966 | Lyman | |
| 3,844,189 A | | 10/1974 | Jardine | |
| 3,999,696 A | * | 12/1976 | Reba et al. | 242/615.1 |
| 4,669,679 A | * | 6/1987 | Pali | 242/615.1 |
| 5,499,673 A | * | 3/1996 | Shiga et al. | 242/615.11 |
| 5,921,127 A | * | 7/1999 | Ogawa et al. | |
| 5,924,619 A | * | 7/1999 | Bartell | 242/615.11 |
| 6,039,283 A | * | 3/2000 | Munoz-Baca et al. | 242/615.4 |
| 6,283,403 B1 | * | 9/2001 | Braun et al. | 242/532.2 |
| 6,364,242 B1 | * | 4/2002 | Braun et al. | 242/532.2 |

FOREIGN PATENT DOCUMENTS

| | | |
|---|---|---|
| DE | 3515519 | 10/1986 |
| EP | 0401824 | 12/1990 |
| EP | 0815974 | 1/1998 |

OTHER PUBLICATIONS

Patent Abstracts of Japan, vol. 018, No. 127 (M–1569), Mar. 2, 1994 & JP 05 317963 A (Nippon Steel Corp), Dec. 3, 1993.

* cited by examiner

*Primary Examiner*—William A. Rivera
(74) *Attorney, Agent, or Firm*—Friedrich Kueffner

(57) ABSTRACT

The invention relates to a deflection method for deflecting a strip (3, 8), especially a metal strip (3, 8), from an initial guide channel (5) to a final guide channel (9) which runs next to said initial guide channel (5). When passing through the initial guide channel (5), the strip (3, 8) comprises an underside (II) which faces away from the final guide channel (9) and has an upper side (I) which faces toward the final guide channel (9). In order to support the deflection of the metal strip (3, 8) from the initial guide channel (5) to the final guide channel (9), the invention provides that the strip (3, 8) is subjected to the action of a medium (12) on the underside (II) thereof during the deflection. The invention also relates to a corresponding deflection device.

8 Claims, 5 Drawing Sheets

DEFLECTION METHOD AND DEFLECTION DEVICE FOR A STRIP, ESPECIALLY A METAL STRIP

BACKGROUND OF THE INVENTION

1. Field of the Invention

The present invention relates to a deflection method for a strip, in particular, a metal strip, from an initial guide channel into a final guide channel which runs next to the initial guide channel, wherein the strip, when passing through the initial guide channel, has an upper side facing the final guide channel and an underside facing away from the final guide channel, as well as a deflection device corresponding thereto.

2. Description of the Related Art

When continuously winding strips, in particular, metal strips, the leading end of a following strip must be guided to a different hasp than the end of the preceding strip. The strip must therefore be guided from an initial guide channel into a final guide channel. Whether for the next strip change a change back to the initial guide channel takes place, as is the case for a multi-hasp device, or whether a change from the initial guide channel into the final guide channel must again be performed, as in the case of a rotor or reversing hasp, is of no consequence within the context of the present invention.

The known deflection devices operate substantially satisfactorily but could still be improved upon.

SUMMARY OF THE INVENTION

The object of the present invention resides in that the prior art deflection methods or the prior art deflection devices are to be improved.

In correspondence thereto, the deflection device has a lower loading device for loading the underside of the strip with a medium.

The medium can be, for example, compressed air or water that is under pressure.

When the deflection device comprises a drive device with an upper drive roll and a lower drive roll, wherein the upper drive roll acts on the upper side and the lower drive roll on the underside, and wherein the lower drive roll has a lower stripper bar for separating the strip from the lower drive roll, the first loading device is preferably arranged on the lower stripper bar.

In the case of a rotor hasp the presence of the upper loading device is sufficient. In the case of a multi-hasp device, on the other hand, the deflection device should have also a second loading device for loading the underside of the strip with the medium so that the return of the strip from the final guide channel into the initial guide channel can also be assisted by loading with the medium.

The upper loading device is also preferably arranged on an upper stripper bar for removing the strip from the upper drive roll, should such an upper stripper bar be present.

The initial guide channel and the final guide channel are, in general, separated from one another by a switch. The switch can have a pointed tip. Preferably, the tip is however rounded. It is especially advantageous to have a rounded tip which is rotatably supported.

BRIEF DESCRIPTION OF THE DRAWING

Further advantages and details result from the other claims as well as the following description of one embodiment. It is shown in a basic illustration in:

DESCRIPTION OF THE PREFERRED EMBODIMENT

Figure 1:
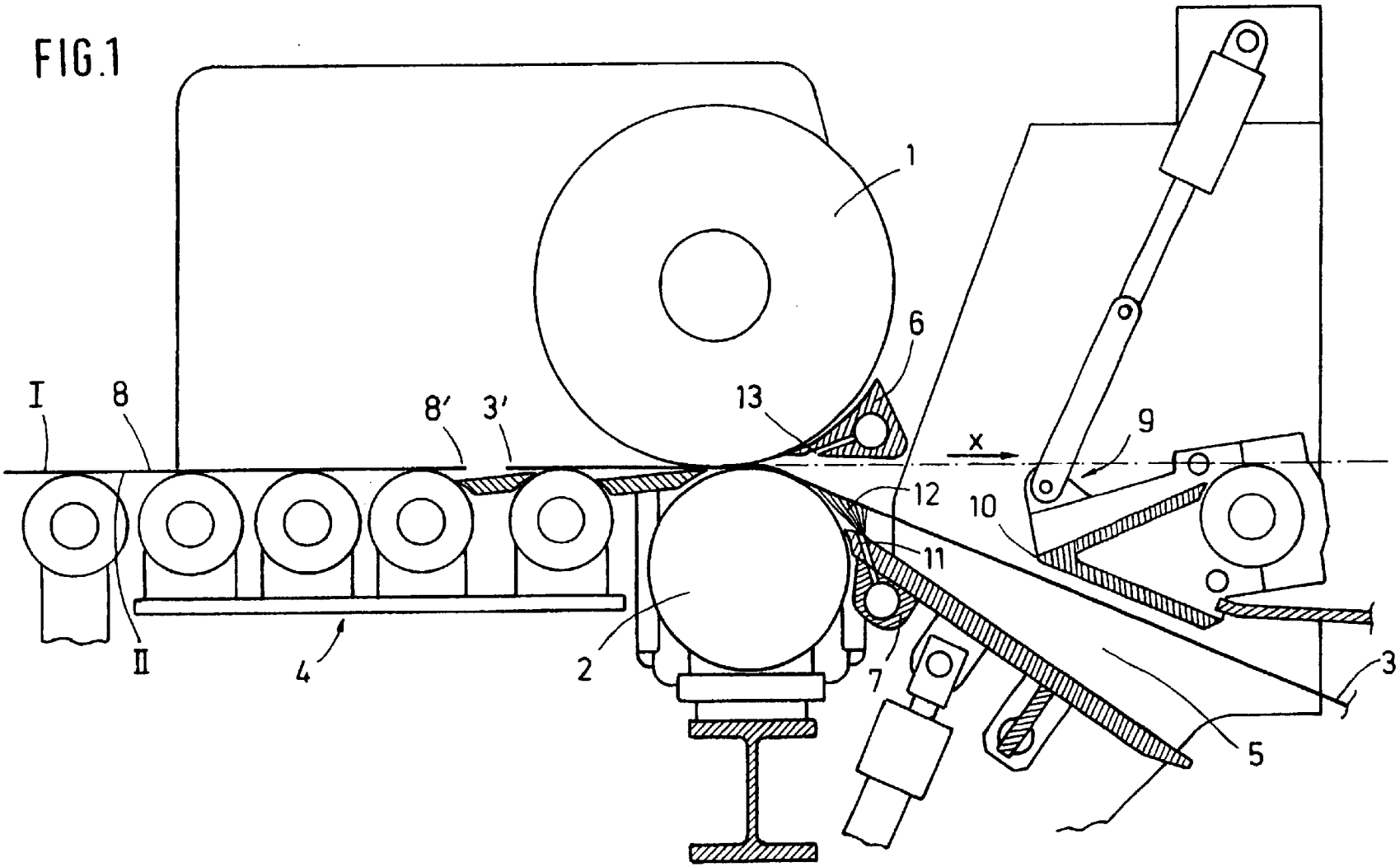
FIG. 1 a deflection device in a first operational state.
Figure 2:
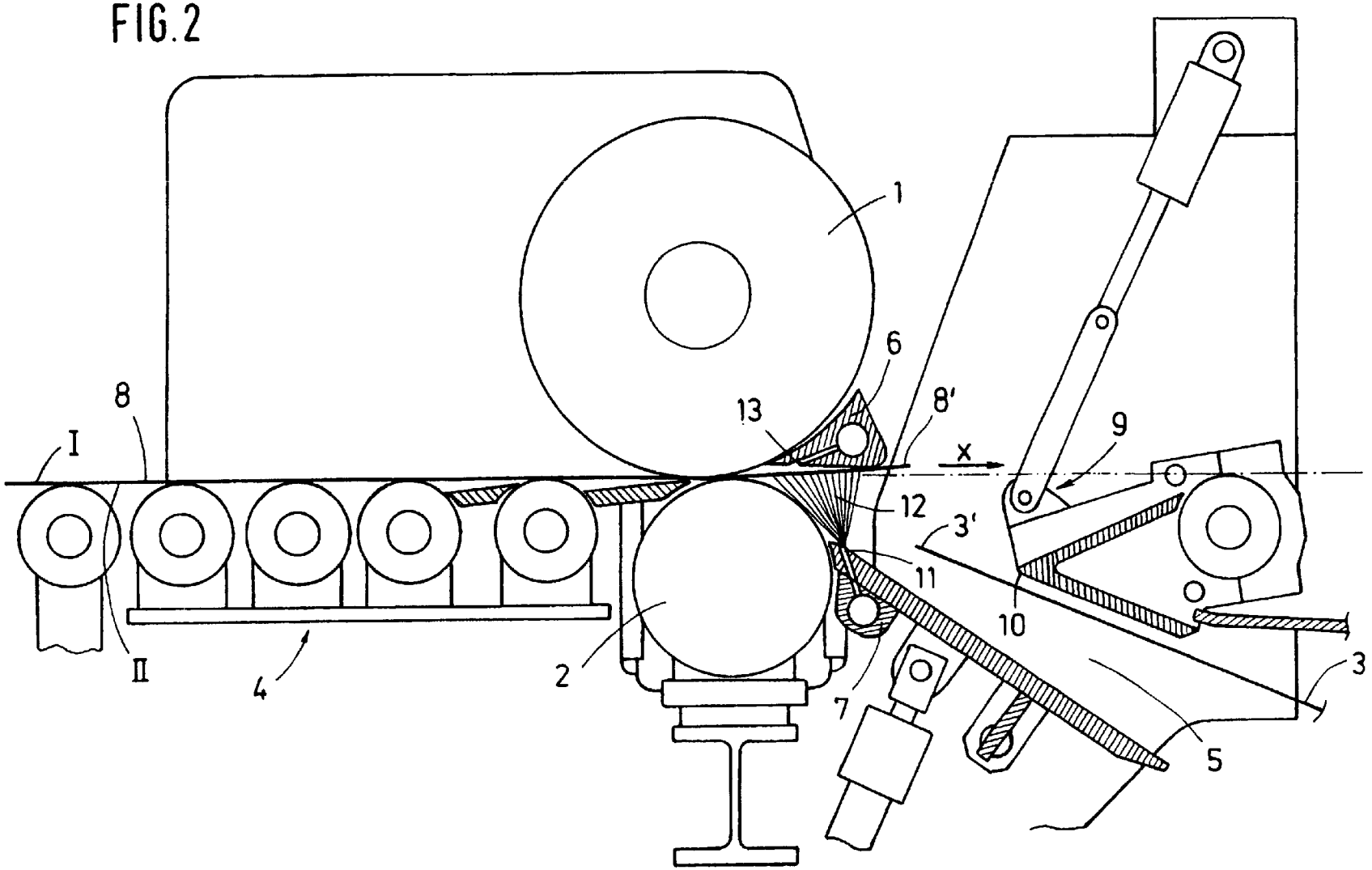
FIG. 2 the deflection device of FIG. 1 in a second operational state.
Figure 3:
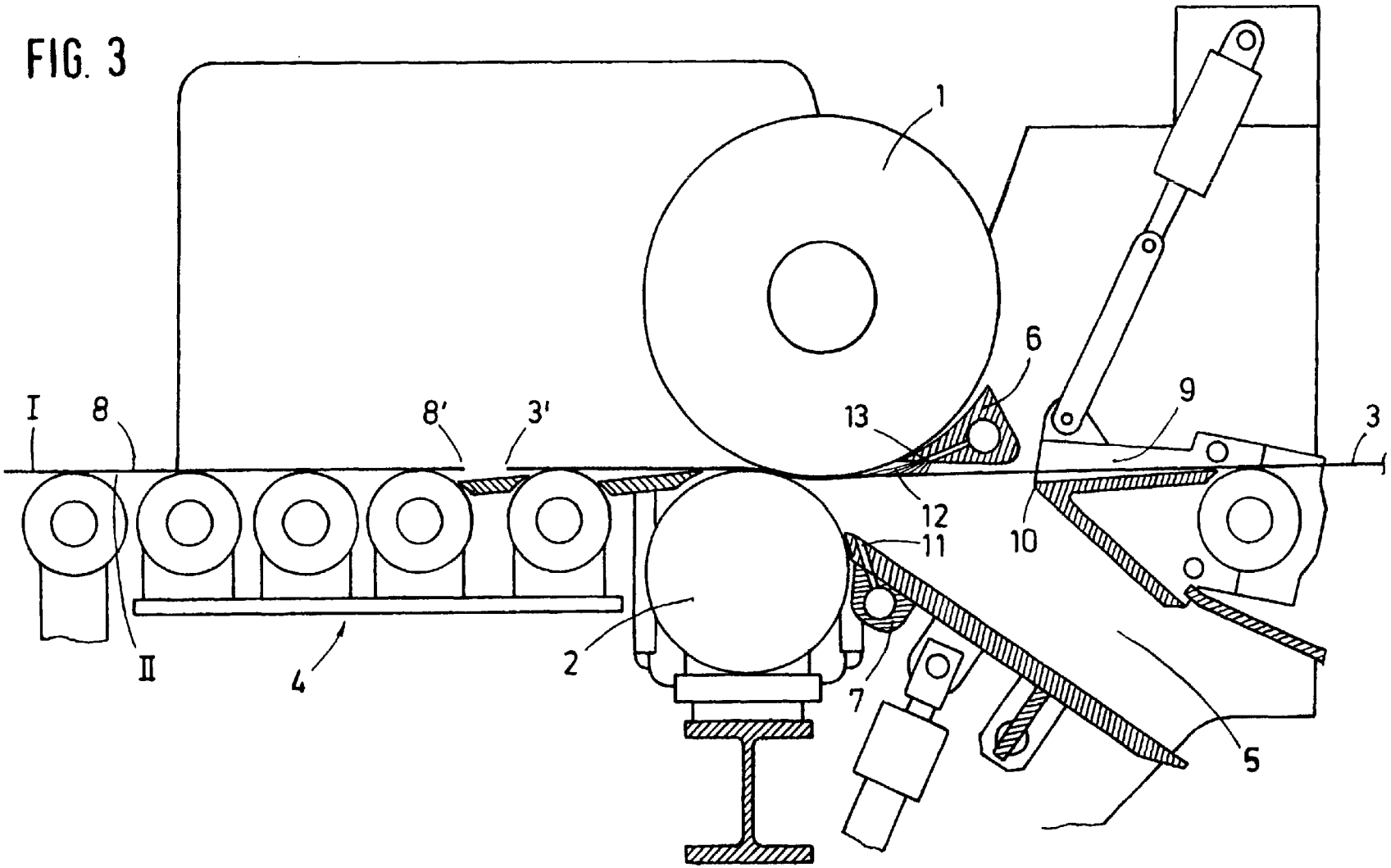
FIG. 3 the deflection device of FIG. in a third operational state.
Figure 4:
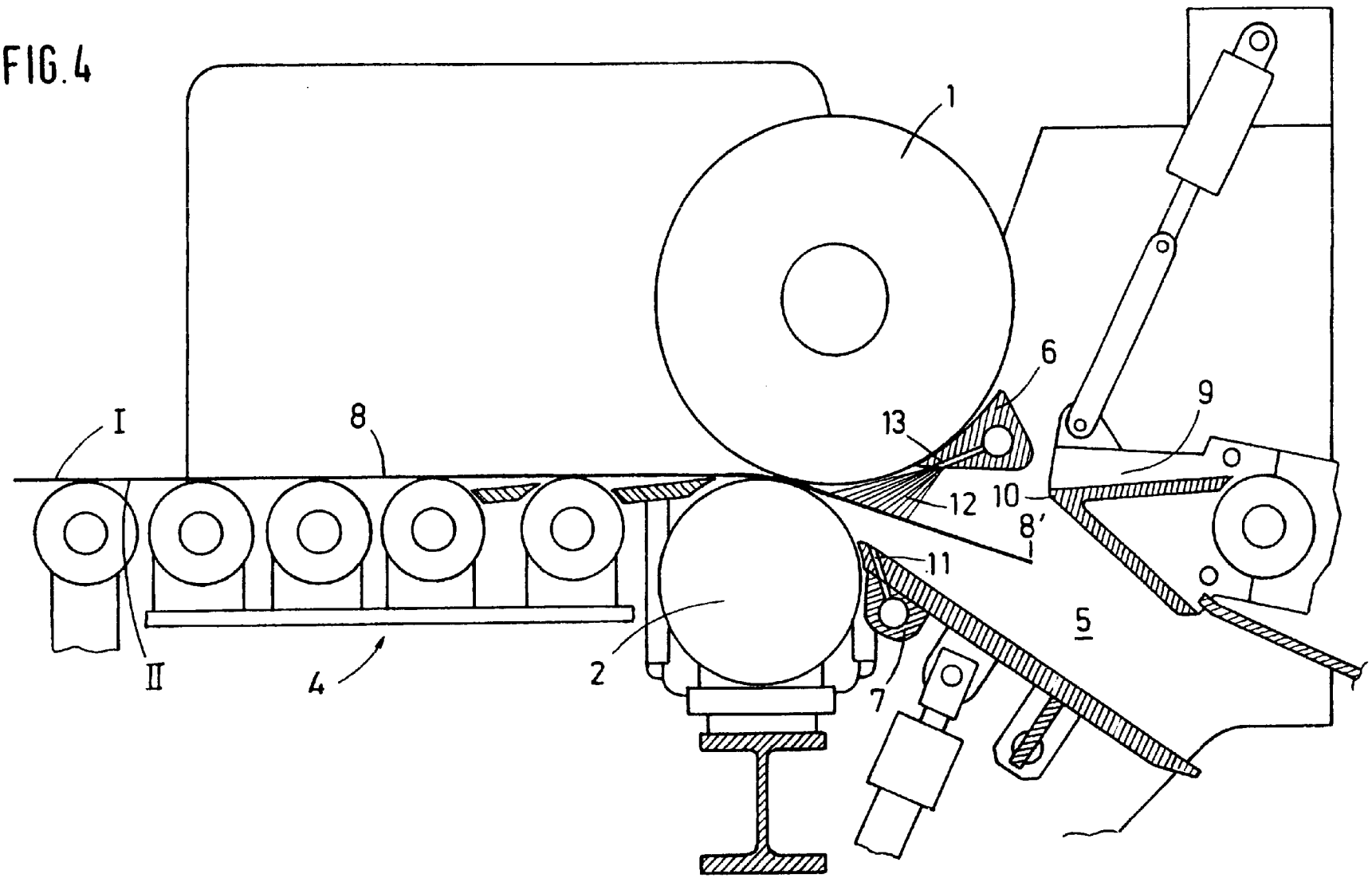
FIG. 4 the deflection device of FIG. 1 in a fourth operational state.
Figure 5:
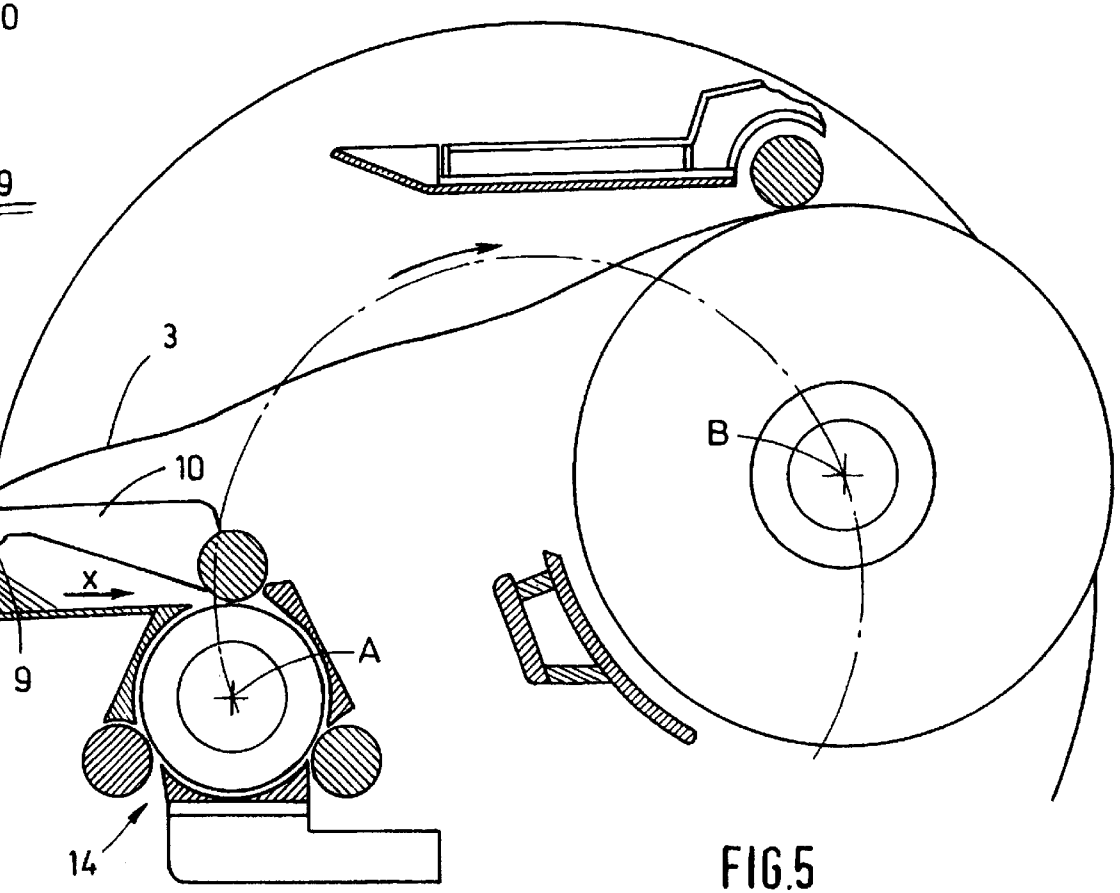
FIG. 5 a further deflection device in a rotor hasp.
Figure 6:
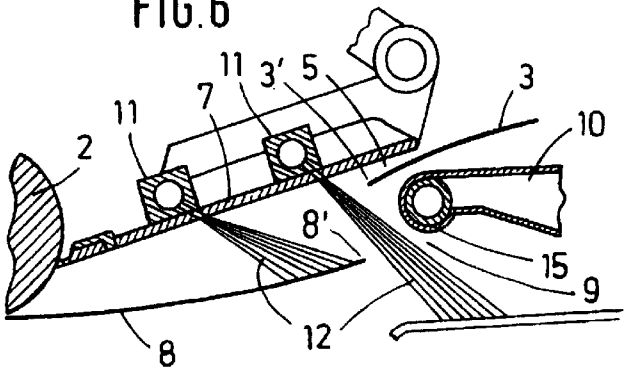
FIG. 6 a switch.

According to FIG. 1 a deflection device comprises a drive device 1, 2 with an upper drive roll 1 and a lower drive roll 2. The drive rolls 1, 2 act on a metal strip 3 with an upper side 1 and an underside II, pull it out of a roll table 4, and transport it farther into an initial guide channel 5.

The metal strip 3 is a thin metal strip with a strip thickness d of maximally approximately 3 mm. Since the metal strip 3 is hot, there is the risk that it adheres to one of the drive rolls 1, 2 when it is no longer under tension. In order to prevent such an adhesion to the drive rolls 1, 2, the upper drive roll 1 is provided with an upper stripper bar 6 and the lower drive roll 2 with a lower stripper bar 7. By means of the stripper bars 6, 7 the strip 3 is removed from the drive roll 1, 2, respectively, should it adhere thereto.

The risk of adhesion of the strip 3 is present only when the metal strip 3 is pushed by the drive rolls 1, 2 without being tensioned. The stripper bars 6, 7 are therefore preferably adjustable relative to the respective drive rolls 1, 2 in order to effect the wear-causing removal only when the metal strip 3 is pushed. As soon as tension is built up in the metal strip 3 behind the drive rolls 1, 2, the stripper bars 6, 7 are pivoted away from the drive rolls 1, 2.

The metal strip 3, as already mentioned, is transported by means of the drive device 1, 2 out of the roll table 4 and is transported into the initial guide channel 5. A hasp (not illustrated), by which the metal strip 3 is wound, is arranged, for example, at the end of the channel.

What is claimed is:

1. A deflection device for deflecting a strip (3, 8) from an initial guide channel (5) into a final guide channel (9) extending adjacent to the initial guide channel (5), wherein the strip (3, 8), when passing through the initial guide channel (5), has an underside (II) facing away from the final guide channel (9) and an upper side (I) facing the final guide channel (9), wherein the deflection device has a lower loading device (11) for loading the underside (II) of the strip (3, 8) with a medium (12), wherein the deflection device has a drive device (1, 2) with an upper drive roll (1) and a lower drive roll (2), wherein the upper drive roll (1) is acting on the upper side (I) and the lower drive roll (2) on the underside (II), wherein the lower drive roll (2) has a lower stripper bar (7) for removing the strip (3, 8) from the lower drive roll (2), and wherein the lower loading device (11) is arranged on the lower stripper bar (7).

2. The deflection device according to claim 1, wherein the medium (12) is compressed air or water under pressure.

3. The deflection device according to claim 1, wherein the lower stripper bar (7) can be advanced to the lower drive roll (2).

4. The deflection device according to claim 1, comprising an upper loading device (13) for loading the upper side (I) of the strip (3, 8) with the medium (12).

5. The deflection device according to claim 4, wherein the upper drive roll (1) has correlated therewith an upper stripper bar (6) for removing the strip (3, 8) from the upper drive roll (1) and in that the upper loading device (13) is arranged on the upper stripper bar (6).

6. The deflection device according to claim 5, wherein the upper stripper bar (6) can be advanced to the lower drive roll (1).

7. The deflection device according to claim 1, wherein the initial guide channel (5) and the final guide channel (9) are separated from one another by a switch (10) and in that the switch (10) has a rounded tip (15).

8. The deflection device according to claim 7, wherein the tip (15) is pivotably supported.

* * * * *